US006397410B1

(12) United States Patent
Steadman

(10) Patent No.: US 6,397,410 B1
(45) Date of Patent: Jun. 4, 2002

(54) BATH LIFT

(75) Inventor: William David Steadman, Stuart, FL (US)

(73) Assignee: William D. Steadman, Port Saint Lucie, FL (US)

( * ) Notice: Subject to any disclaimer, the term of this patent is extended or adjusted under 35 U.S.C. 154(b) by 0 days.

(21) Appl. No.: 09/509,324

(22) PCT Filed: Sep. 22, 1998

(86) PCT No.: PCT/GB98/02865

§ 371 (c)(1),
(2), (4) Date: Jun. 19, 2000

(87) PCT Pub. No.: WO99/15127

PCT Pub. Date: Apr. 1, 1999

(51) Int. Cl.[7] ..... A47K 3/02
(52) U.S. Cl. ..... 4/561.1; 4/564.1; 4/560.1
(58) Field of Search ..... 4/564.1, 565.1, 4/566.1, 560.1, 561.1, 559; D34/33

(56) References Cited

U.S. PATENT DOCUMENTS 2,624,053 A * 1/1953 Beckwith ..... 4/565.1
2,788,527 A * 4/1957 Steven ..... 4/565.1
3,317,928 A 5/1967 Root
3,581,316 A * 6/1971 Petersen ..... 4/566.1

FOREIGN PATENT DOCUMENTS

EP 0 403 235 A1 6/1990
WO WO 1/00080 1/1991

* cited by examiner

*Primary Examiner*—Gregory L. Huson
*Assistant Examiner*—Huyen Le
(74) *Attorney, Agent, or Firm*—Watts, Hoffmann, Fisher & Heinke Co., LPA

(57) ABSTRACT

A bath lift (10), the lift (10) comprising a housing (12) locatable to a first side (18) of a bath (20). A flexible band (72) is provided which is selectively extendable from the housing (12) across the bath (20) to a second side (86) of the bath (20) such that a person can sit on the band (72). The lift (10) comprises means for selectively feeding the band (72) out or in of the housing (12) such that when the band (72) is fed out a person sitting thereon is lowered into a sitting position to the bottom of the bath (20), and when the band (72) is fed in, a person sitting thereon is raised off the bottom of the bath (20). The lift (10) is arranged to be selectively movable between an in use position with the band (72) extending from the housing (12) across the bath (20), and an out of use condition with the band (72) located at least substantially within the housing (12). The housing (12) lies in a generally flat configuration to the first side (18) of the bath (20).

39 Claims, 5 Drawing Sheets

BATH LIFT

This invention concerns bath lifts; and particularly but not exclusively bath lifts for lowering a person in a seated position from substantially level with the top of a bath to sit on the bottom of the bath, and to subsequently raise the person back off the bottom of the bath.

A number of bath lifts are presently available. Such lifts tend to be visually relatively obtrusive even when not in use. Accordingly, such lifts can be visually unappealing. Also, it is sometimes preferred for a bath lift not to be obviously recognisable as such, at least when not in use.

According to the present invention there is provided a bath lift, the lift comprising a housing locatable to a first side of a bath, a flexible band which is selectively extendable from the housing across the bath to a second side of the bath such that a person can sit on the band, the lift comprising means for selectively feeding the band out or in of the housing such that when the band is fed out a person sitting thereon is lowered into a sitting position to the bottom of the bath, and when the band is fed in, a person sitting thereon is raised off the bottom of the bath, the lift being arranged to be selectively movable between an in use position with the band extending from the housing across the bath, and an out of use condition with the band located at least substantially within the housing, the housing lying in a generally flat configuration to said first side of the bath.

The bath lift is preferably arranged such that the housing lies in a generally vertical plane, and desirably can be mounted to lie against a wall or fixture.

The bath lift is preferably arranged such that a free end of the band is selectively mountable on said second side of the bath, and a first guide is provided in or adjacent a lower part of a housing such that, from said free end, the band extends across the bath, a second movable guide being provided in the housing above the first guide, with the band extending around the second guide to a fixed end below the second guide, means being provided for moving the second guide relative to the first guide so as to feed the band past the first guide and therefore into or out of the housing to selectively tighten or loosen the band extending across the bath, to raise or lower a person sitting on the band.

The second guide is preferably movable in a generally vertical direction. The second guide may extend between generally vertically aligned guide paths.

The moving means may comprise a rotatable threaded elongate member extending substantially vertically, and engagable with a threaded member connected to the second guide such that rotation of the threaded elongate member causes the second guide to rise or fall.

The guide paths may comprise tracks, and the second guide may extend between two carriages each located in a respective one of the tracks. The tracks may comprise lengths of channel section open sidewards to face each other.

A motor may be provided to rotate the threaded elongate member, and the motor may be located above the threaded elongate member.

Control means may be provided for the motor operable by a person sitting on the band. The control means may comprise an elongate member with limited vertical movement, the elongate member in a relaxed condition adopting a neutral position but being movable upwardly or downwardly, with upward movement connecting the motor for rotation in one direction, and downward movement of the elongate member connecting the motor for rotation in the other direction. An engagement member is preferably provided on the elongate member engagable respectively with one of two switches when the elongate member is urged from a relaxed condition. The elongate member preferably extends substantially vertically.

The positioning of the band on the fixed end may be adjustable. The fixed end may comprise a member around which the band extends in a closed loop. The fixed end member may be selectively removable from the housing. The positioning of the closed loop may be adjustable, and a fastener such as a fleece and hook fastener may be provided on the end of the band to permit a loop to be formed around the fixed end member. With the fixed end member removed from the housing a required amount of band may be wound therearound to provide a required position of the closed loop along the band.

The housing may comprise a main body locatable against a wall or fixture, and containing at least the fixed end member, the second guide and the threaded elongate member. The housing may also comprise a door which when closed covers at least a substantial part of the band which is located in the main body. The door may comprise on an inner side, engagement means for accepting the free end of the band when in the out of use condition such that substantially all of the band in said condition is located within the housing. The engagement means may comprise a bar over which the band can lie in a loop, and the bar may be pivotally mounted on the inside of the door. A mirror or other decorative arrangement may be provided on the outside of the door.

The bath lift may comprise holding means mountable on any of the second side of the bath, on the floor adjacent thereto, or a similar location, to releasably hold the free end of the band. The holding means may be arranged to automatically hold the free end of the band upon the free end being presented thereinto.

A fixing member may be provided on the free end of the band, and the fixing member may comprise a bar extending across the free end of the band and held within a closed loop of band. The fixing member may also comprise a profiled member mounted on the bar, and the profiled member may comprise an engagement formation and/or a handle formation.

The holding means may comprise a member presenting an opening into which the fixing member, and desirably the engagement formation thereof, is locatable. Resilient means may be provided for retaining the fixing member in the opening.

Lock means may be provided for locking the housing closed. The lift may be arranged to be coin operable, or only operable when a specific key is inserted therein.

An embodiment of the present invention will now be described by way of example only with reference to the accompanying drawings, in which.

Figure 1:
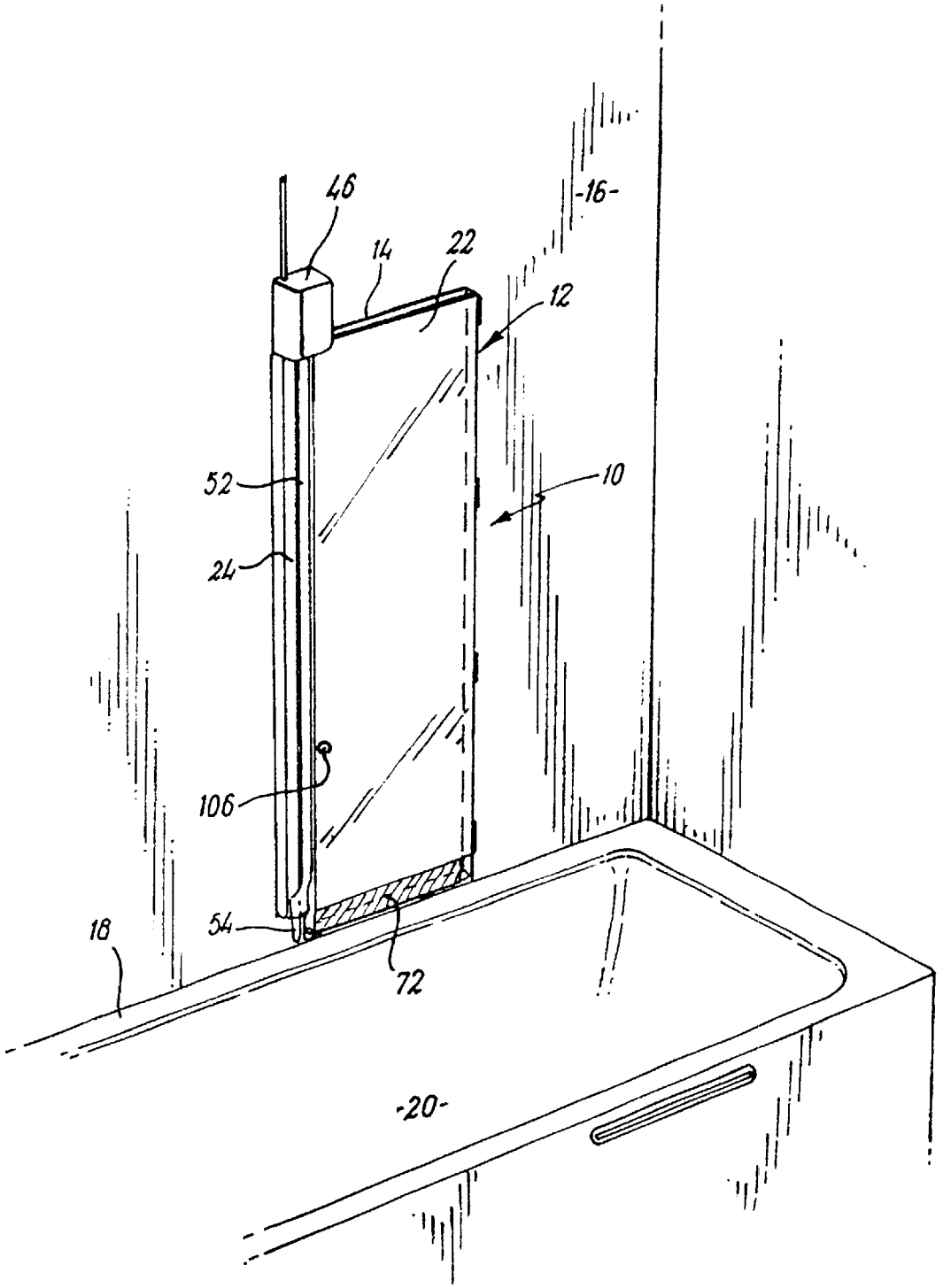
FIG. 1 is a diagrammatic perspective view of bath lift apparatus according to the invention in a closed and out of use condition.

The drawings show a bath lift 10 comprising a substantially flat housing 12. The housing 12 comprises an open rectangular frame 14 of a small depth which is mounted on the wall 16 adjacent a first side 18 of a bath 20. A door 22 is provided for the housing 12, which is hinged along one side of the frame 14 and extends across almost the whole width of the frame 14. A cover 24 covers the narrow strip along the side of the frame 14 which is not closed by the door 22.

The sides 26 of the frame 14 are in the form of inwardly facing channel section which define tracks. A bar 28 extends across the frame 14 towards the lower end thereof. The bar 28 is removably mounted against the frame 14 by bolts 30. A carriage 32 slidably extends in each of the tracks 26, and each of the carriages 32 comprise a pair of spaced rollers 34 engagable in the tracks with the rollers 34 mounted about horizontal axes. A further roller (not shown) may be provided at the lower end of each carriage 32 extendable about a vertical axis. An upper and a lower bar 36,38 extend between the respective carriages 32, and strengthening webs 40 extend between each carriage 32 and the lower bar 38. A threaded socket 42 is provided in the upper end of the left hand carriage 32 as shown in the drawings. The socket 42 has a threaded through hole with a vertical axis.

A threaded elongate member 40 is provided extending adjacent the left hand track 26 as shown in the drawings, and engagingly extending through the socket 42. The member 44 is rotatably mounted within the frame 14 and extends into a housing 46 thereabove. An electric motor 48 is located within the housing 46 and connected to the member 44 to cause rotation thereof in either direction.

A control arrangement 50 is provided for the motor 48. The arrangement 50 comprises an elongate member 52 located parallel to the member 44 but outside of the housing 12. The member 52 is located at its lower end on an upstanding pin 54 which extends within the member 52. At the upper end of the member 52 a further housing 56 located immediately below the housing 46, and the upper end of the member 52 extends into the housing 56.

Figure 5:
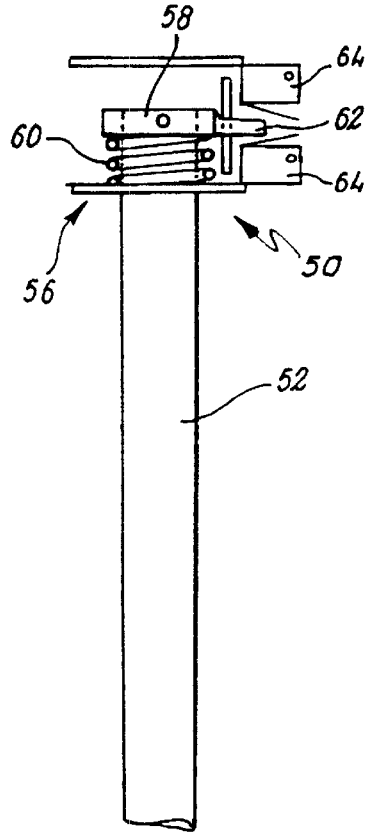
FIG. 5 is a diagrammatic side view of part of the apparatus of FIG. 1.
Figure 4:
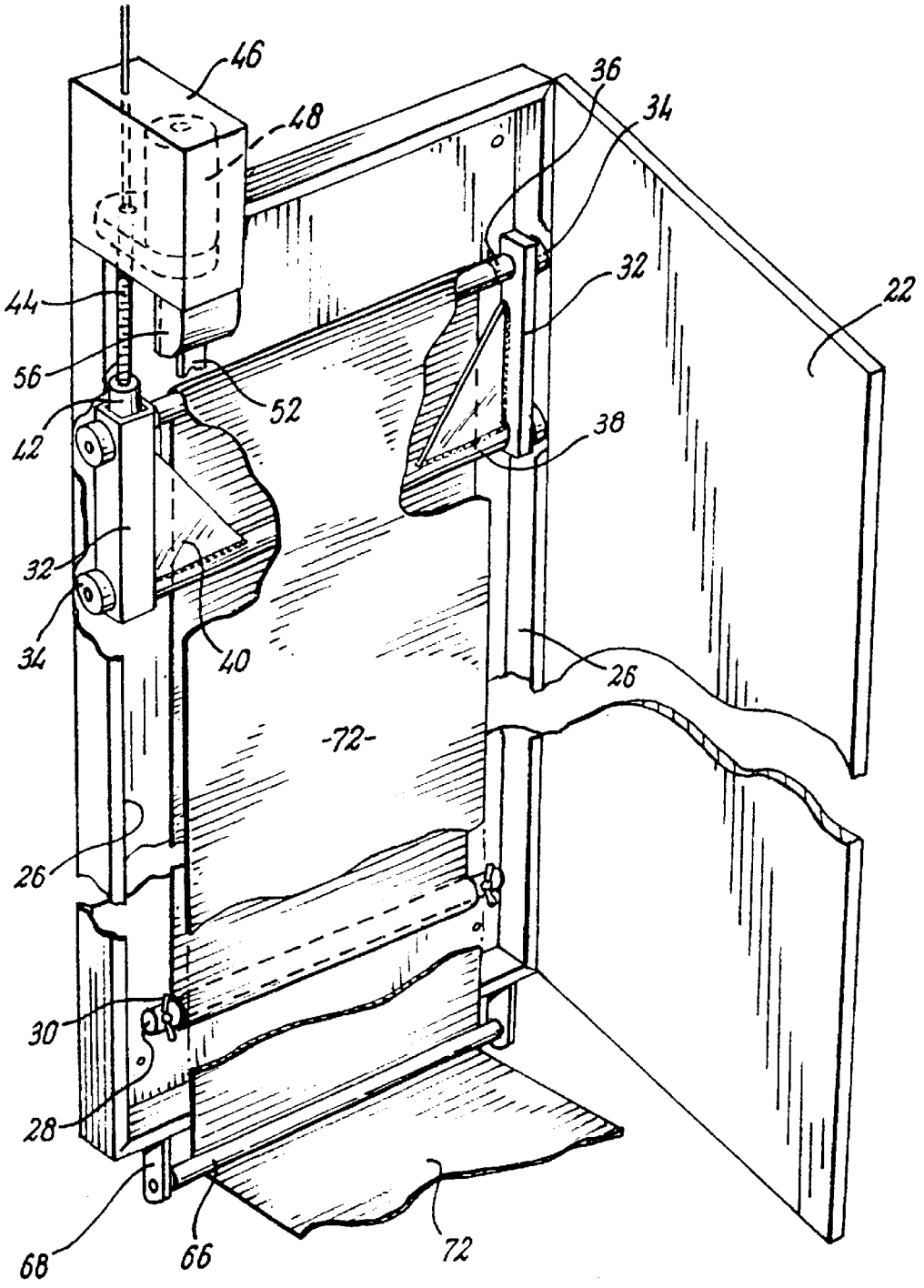
FIG. 4 is an enlarged diagrammatic perspective view of the apparatus of FIG. 1 in an open and in use condition.
Figure 6:
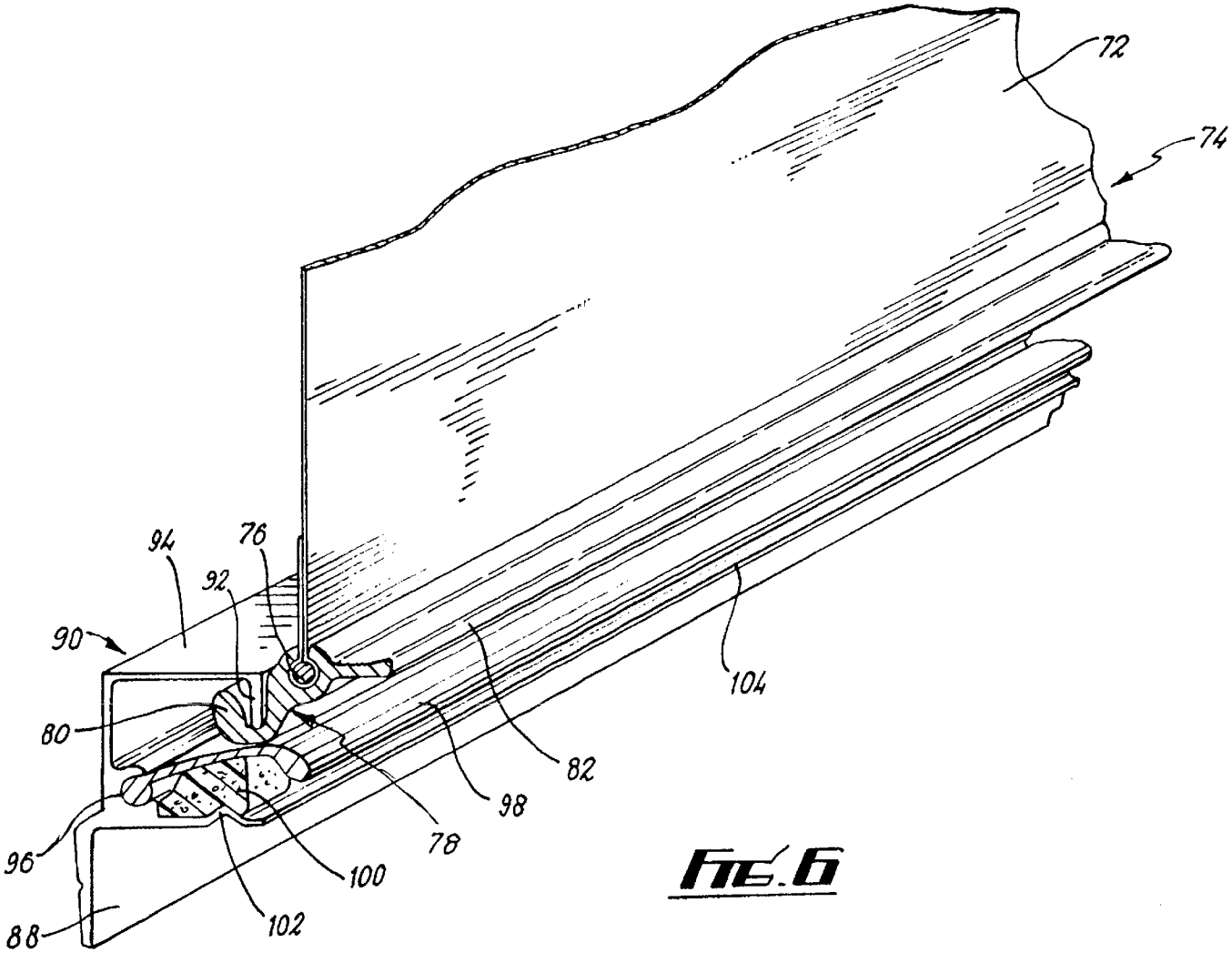
FIG. 6 is a diagrammatic perspective view of a further part of the apparatus of FIG. 1.

An engagement collar 58 is provided on the upper end of the member 52. A spring 60 is provided around the member 52 extending between the collar 58 and a lower surface of the housing 56. The spring 60 urges the member 52 into a neutral position as shown in FIG. 5. The collar 58 comprises a finger 62 which in the neutral position locates without contact between two micro switches 64. When the member 52 is pulled downwardly the finger 62 actuates a lower of the switches 64 to cause the motor 48 to rotate in a first direction such that the carriages 32 move downwardly. If the member 52 is pushed upwardly this will actuate the upper switch 64 to cause the motor 48 to rotate in the opposite direction and hence the carriages 32 to move upwardly.

A guide bar 66 extends between two projections 68 projecting downwardly from the frame 14. A support bar 70 (FIG. 2) is pivotally mounted about one end to the inside of the door 22 about a third of the way up the door 22, such that the bar 70 can lie flat against the inside of the door 22 or pivot outwardly therefrom.

The lift 10 comprises a flexible band 72 located as follows. A closed loop is provided in an end of the band 72 around the bar 28. A fastener such as fleece and hook fastener is provided on the band 72 to permit the loop to be formed, and the band is then rolled around the bar 28, with the bar 28 removed from the frame 14, to provide a required total length of band 72. From the bar 22 the band extends upwardly within the frame 14 over the inner side of the upper bar 36 to extend downwardly still within the frame 14 to the inner side of the guide bar 66.

Figure 2:
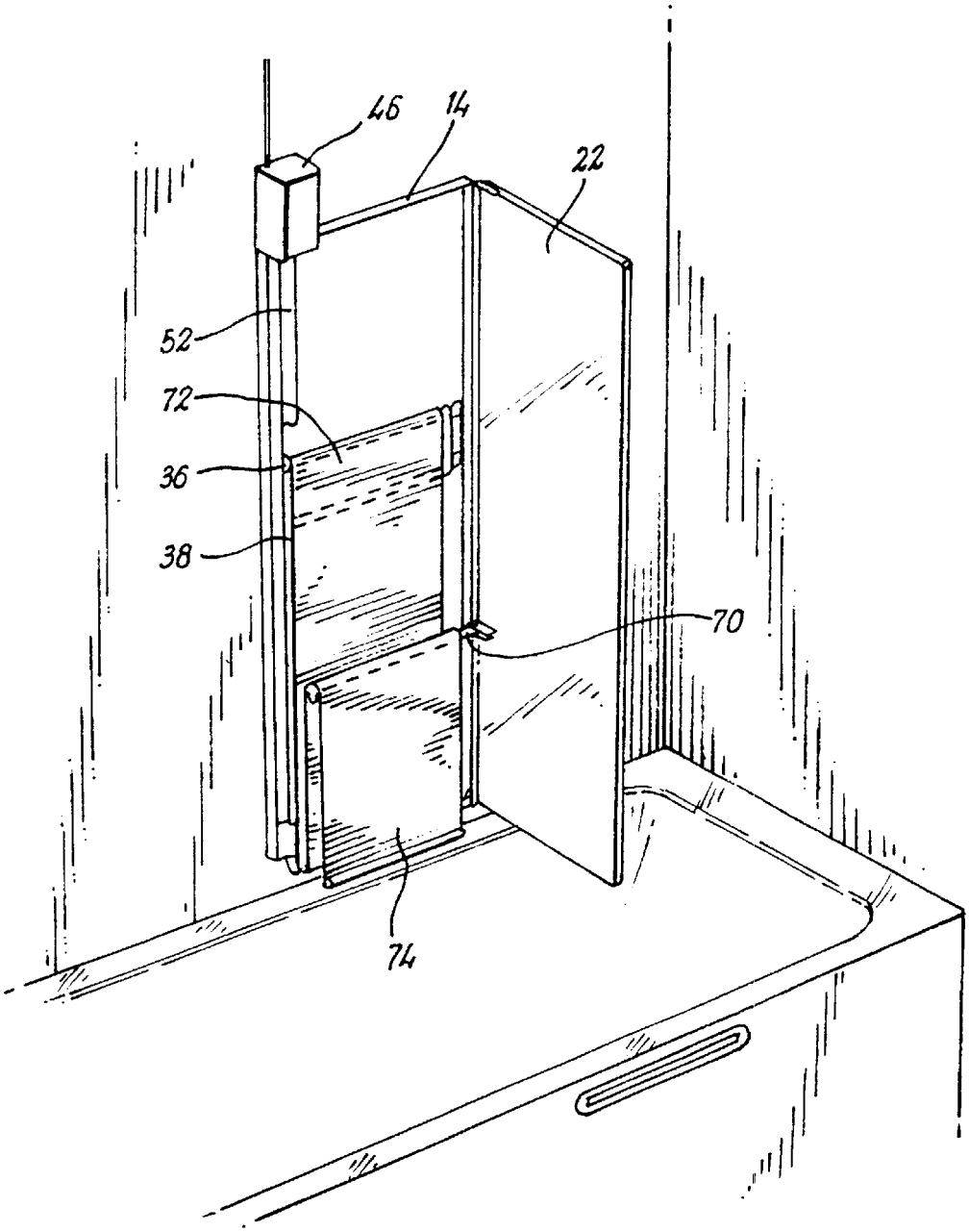
FIG. 2 is a similar view to FIG. 1 but with the apparatus in an open condition.

In an out of use condition as shown in FIG. 2 the free end 74 of the band 72 is looped over the support bar 70 such that substantially all of the band 72 can lie within the housing 12 and be contained therewithin if the door 22 is shut as shown in FIG. 1.

In an in use condition the band 72 is taken off the support bar 70 and extends across the bath 20. A bar 76 is mounted across the free end 74 and held therein by a stitched closed loop. A profiled member 78 is mounted on the bar 76. The member 78 comprises a first part shaped to define a lip 80, and a second part extending on the opposite side of the member 78 to provide a tab 82.

A holding arrangement 84 is provided. The arrangement 84 can be mounted on the second side 86 of the bath just below the top thereof as shown in the drawings. Alternatively the arrangement 84 can be mounted lower down on the bath, on the floor adjacent the bath, or elsewhere. The arrangement 84 comprises a profiled strip which has a lower section 88 to define a mounting flange to enable mounting thereof on a bath 20 or otherwise. Extending above the section 88 is an outwardly facing channel section 90 with a downwardly pointing lip 92 on the top wall 94 of the channel. A recess 96 with a narrowed opening is provided along the lower insider corner of the channel. Pivotally located within the recess 96 is the circular section end of a retaining strip 98. A length of resilient material 100 such as foamed plastics material is provided beneath the strip 98 to urge the strip upwardly to at least substantially close the channel. A projection 102 is provided running along the bottom wall 104 of the channel to retain the resilient material 100 in place.

Figure 3:
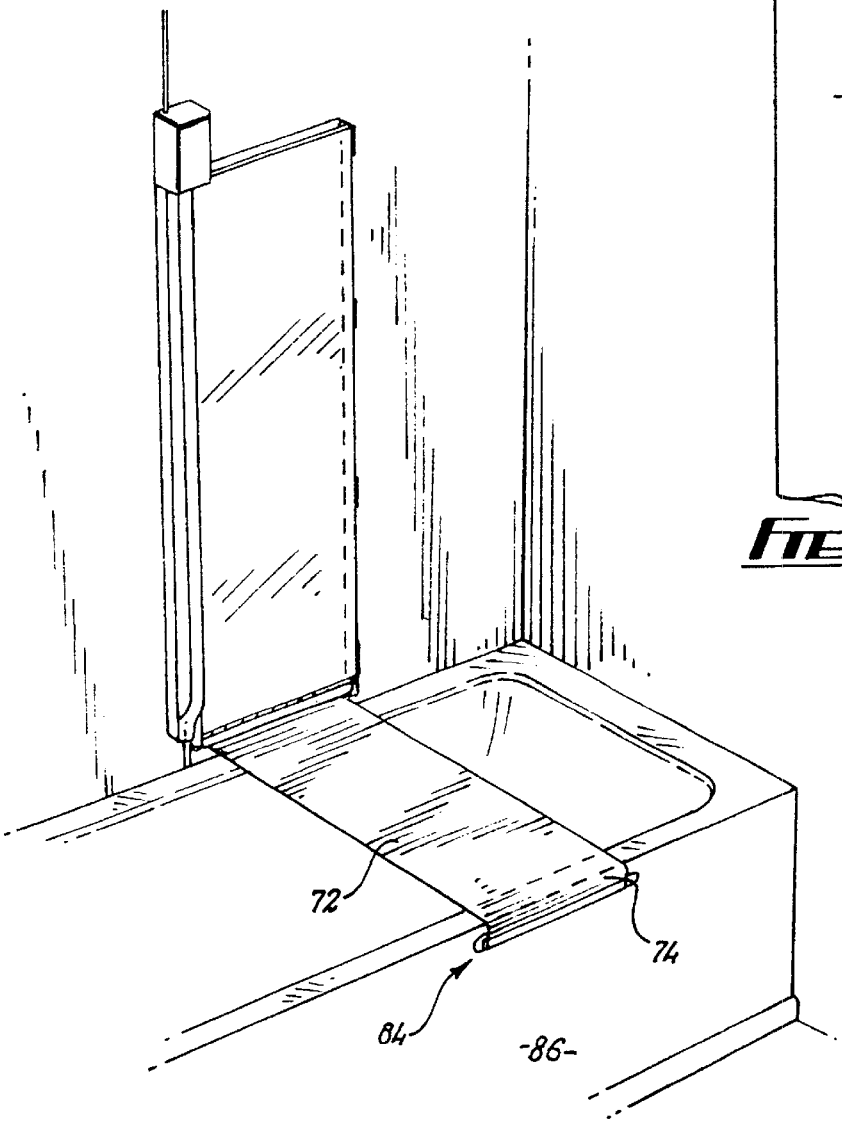
FIG. 3 is a similar view to FIG. 1 but with the apparatus in an in-use condition.

To use the lift 10, the free end 74 is taken out of the housing 12 as outlined above. The end 74 is then located in the holding arrangement 84 by pushing the lip 80 into the channel of the section 90 to be retained therein by the strip 98. The band 72 will then be extending across the top of the bath 20 as shown in FIG. 3. If the band 72 is not taut it can be tightened by pushing the member 32 upwards to activate the motor 48 to move the carriages 32 upwards and hence lengthen the portion of the bands 72 located within the housing 12. When the band 72 is taut a person can sit thereon. To lower themselves into the bath 20, the person pulls the member 52 downwardly to actuate the motor 48 in a required direction to feed the band 72 out of the housing 12 until the band 72 reaches the bottom of the bath 20. Following bathing a person can be lifted back up to the top of the bath 20 by pushing the member 32 upwardly such that the band 72 is fed back into the housing 12.

There is thus described a bath lift with a number of advantageous features. The lift allows a person to be lowered and raised to and from the bottom of a bath in a conventional manner using a control arrangement which is extremely easy to operate. The lift only projects out a short distance from the wall and when not in use provides a very neat and unobtrusive arrangement. The front of the door 22 can be in the form of a mirror as shown in the drawings or can be decorated in many different ways. The door could be provided with a panel which could be decorated to correspond to the decoration surrounding the bath. For use in commercial establishments a lock could be provided on the door 22 as shown by the lock 106 in FIG. 1. Alternatively, a coin or key operated mechanism could be provided.

Various other modifications may be made without departing from the scope of the invention. For example, a different method could be provided for moving the carriages within the housing. A different method could be provided for mounting the free end of the band on the second side of the bath, though the present arrangement has been found to be particularly advantageous.

Whilst endeavouring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

What is claimed is:

1. A bath lift (10), the lift (10) comprising a housing (12) locatable to a first side (18) of a bath (20), a flexible band (72) which is selectively extendable from the housing (12) across the bath (20) to a second side (86) of the bath (20), the lift (10) comprising means for selectively feeding the band (72) out or in of the housing (12) such that when the band (72) is fed out a person sitting thereon is lowered into a sitting position to the bottom of the bath (20), and when the band (72) is fed in, a person sitting thereon is raised off the bottom of the bath (20), the lift (10) being arranged to be selectively movable between an in use position with the band (72) extending from the housing (12) across the bath (20), and an out of use condition with the band (72) located at least substantially within the housing (12), characterised in that in the out of use condition the bath lift (12) lies in a generally flat configuration to said first side (18) of the bath (20), further characterised in that the bath lift (10) is arranged such that a free end (74) of the band (72) is selectively mountable on said second side (86) of the bath (20), and a first guide (66) is provided in or adjacent a lower part of a housing (12) such that, from said free end (74), the band (72) extends across the bath (20), a second movable guide (36,38) being provided in the housing (12) above the first guide (66), with the band (72) extending around the second guide to a fixed end below the second guide (36,38), means being provided for moving the second guide (36,38) relative to the first guide (66) so as to feed the band (72) past the first guide (66) and therefore into or out of the housing (12) to selectively tighten or loosen the band (72) extending across the bath (20), to raise or lower a person sitting on the band (72).

2. A bath lift according to claim 1, characterised in that the bath lift (10) is arranged such that the housing (12) lies in a generally vertical plane.

3. A bath lift according to claim 1, characterised in that the bath lift can be mounted to lie against a wall (16).

4. A bath lift according to claim 1, characterised in that the bath lift can be mounted to lie against a fixture.

5. A bath lift according to claim 1, characterised in that the second guide (36,38) is movable in a generally vertical direction.

6. A bath lift according to claim 1, characterised in that the second guide (36,38) extends between generally vertically aligned guide paths.

7. A bath lift according to claim 6, characterised in that the guide paths comprise tracks (26).

8. A bath lift according to claim 7, characterised in that the second guide (36,38) extends between two carriages (32) each located in a respective one of the tracks (26).

9. A bath lift according to claim 1, characterised in that the tracks (26) comprise lengths of channel section open sidewards to face each other.

10. A bath lift according to claim 1, characterised in that the moving means comprises a rotatable threaded elongate member (44) extending substantially vertically, and engagable with a threaded member (42) connected to the second guide (36,38) such that rotation of the threaded elongate member (44) causes the second guide (36,38) to rise or fall.

11. A bath lift according to claim 10, characterised in that a motor (48) is provided to rotate the threaded elongate member (44).

12. A bath lift according to claim 9, characterised in that the motor (48) is located above the threaded elongate member (44).

13. A bath lift according to claim 11, characterised in that control means (50) are provided for the motor (48) operable by a person sitting on the band (72).

14. A bath lift according to claim 13, characterised in that the control means (50) comprise an elongate member (52) with limited vertical movement, the elongate member (52) in a relaxed condition adopting a neutral position but being movable upwardly or downwardly, with upward movement connecting the motor (48) for rotation in one direction, and downward movement of the elongate member (32) connecting the motor (48) for rotation in the other direction.

15. A bath lift according to claim 14, characterised in that an engagement member (58) is provided on the elongate member (52) engageable respectively with one of two switches (64) when the elongate member (52) is urged from a relaxed condition.

16. A bath lift according to claim 14, characterised in that the elongate member (52) extends substantially vertically.

17. A bath lift according to claim 1, characterised in that the positioning of the band (72) on the fixed end is adjustable.

18. A bath lift according to claim 1, characterised in that the fixed end comprises a member (28) around which the band (72) extends in a closed loop.

19. A bath lift according to claim 18, characterised in that the fixed end member (28) is selectively removable from the housing (12).

20. A bath lift according to claim 18, characterised in that the positioning of the closed loop is adjustable.

21. A bath lift according to claim 18, characterised in that a fastener such as a fleece and hook fastener is provided on the end of the band (72) to permit a loop to be formed around the fixed end member (28).

22. A bath lift according to claim 18, characterised in that with the fixed end member (28) removed from the housing (12) a required amount of band (72) is wound therearound to provide a required position of the closed loop along the band (72).

23. A bath lift according to claim 18, characterised in that the housing (12) comprises a main body (14) locatable against a wall (16) or fixture, and containing at least the fixed end member (28), the second guide and the threaded elongate member (44).

24. A bath lift according to claim 23, characterised in that the housing (12) also comprises a door (22) which when closed covers at least a substantial part of the band (72) which is located in the main body (14).

25. A bath lift according to claim 24, characterised in that the door (22) comprises on an inner side, engagement means (70) for accepting the free end (74) of the band (72) when in the out of use condition such that substantially all of the band (72) in said condition is located within the housing (12).

26. A bath lift according to claim 25, characterised in that the engagement means (70) comprises a bar (70) over which the band (72) can lie in a loop.

27. A bath lift according to claim 26, characterised in that the bar (70) is pivotally mounted on the inside of the door (22).

28. A bath lift according to claim 24, characterised in that a mirror or other decorative arrangement is provided on the outside of the door (22).

29. A bath lift according to claim 1, characterised in that the bath lift (10) comprises holding means (84) mountable on any of the second side (86) of the bath (20), on the floor adjacent thereto, or a similar location, to releasably hold the free end (74) of the band (72).

30. A bath lift according to claim 29, characterised in that the holding means (84) is arranged to automatically hold the free end (74) of the band (72) upon the free end (74) being presented thereinto.

31. A bath lift according to claim 29, characterised in that a fixing member (76) is provided on the free end of the band (72).

32. A bath lift according to claim 31, characterised in that the fixing member comprises a bar (76) extending across the free end (74) of the band (72) and held within a closed loop of band.

33. A bath lift according to claim 31, characterised in that the fixing member (76) also comprises a profiled member (78) mounted on the bar (76).

34. A bath lift according to claim 33, characterised in that the profiled member (78) comprises an engagement, formation (80) and/or a handle formation.

35. A bath lift according to claim 31, characterised in that the holding means (84) comprises a member (90) presenting an opening into which the fixing member (76), and desirably the engagement formation (80) thereof, is locatable.

36. A bath lift according to claim 35, characterised in that resilient means (100) are provided for retaining the fixing member (76) in the opening (90).

37. A bath lift according to claim 1, characterised in that lock means (106) are provided for locking the housing (12) closed.

38. A bath lift (10), the lift (10) comprising a housing (12) locatable to a first side (18) of a bath (20), a flexible band (72) which is selectively extendable from the housing (12) across the bath (20) to a second side (86) of the bath (20), the lift (10) comprising means for selectively feeding the band (72) out or in of the housing (12) such that when the band (72) is fed out a person sitting thereon is lowered into a sitting position to the bottom of the bath (20), and when the band (72) is fed in, a person sitting thereon is raised off the bottom of the bath (20), the lift (10) being arranged to be selectively movable between an in use position with the band (72) extending from the housing (12) across the bath (20), and an out of use condition with the band (72) located at least substantially within the housing (12), characterised in that in the out of use condition the bath lift (12) lies in a generally flat configuration to said first side (18) of the bath (20); further characterised in that the lift (10) is arranged to be coin operable.

39. A bath lift (10), the lift (10) comprising a housing (12) locatable to a first side (18) of a bath (20), a flexible band (72) which is selectively extendable from the housing (12) across the bath (20) to a second side (86) of the bath (20), the lift (10) comprising means for selectively feeding the band (72) out or in of the housing (12) such that when the band (72) is fed out a person sitting thereon is lowered into a sitting position to the bottom of the bath (20), and when the band (72) is fed in, a person sitting thereon is raised off the bottom of the bath (20), the lift (10) being arranged to be selectively movable between an in use position with the band (72) extending from the housing (12) across the bath (20), and an out of use condition with the band (72) located at least substantially within the housing (12), characterised in that in the out of use condition the bath lift (12) lies in a generally flat configuration to said first side (18) of the bath (20) further characterised in that the lift is arrange to be only operable when a specific key is inserted therein.

* * * * *